United States Patent [19]

Nabeshima et al.

[11] 4,172,685

[45] Oct. 30, 1979

[54] METHOD AND APPARATUS FOR AUTOMATIC OPERATION OF CONTAINER CRANE

[75] Inventors: Yasuo Nabeshima, Kudamatsu; Hiroshi Kawasaki, Matsudo; Kengo Sugiyama, Abiko, all of Japan

[73] Assignee: Hitachi, Ltd., Japan

[21] Appl. No.: 842,356

[22] Filed: Oct. 14, 1977

[30] Foreign Application Priority Data

Oct. 22, 1976 [JP] Japan ..... 51-126135
Jul. 1, 1977 [JP] Japan ..... 52-77925

[51] Int. Cl.[2] ..... B63B 27/00

[52] U.S. Cl. ..... 414/139; 212/14; 212/15; 294/67 DA; 414/140; 414/786

[58] Field of Search ..... 214/12, 14, 38 CC, 15 R, 214/38 C, 152, 38 CA; 212/10, 11, 13, 14, 15, 16, 18, 17; 294/67 D, 67 DA, 67 DB

[56] References Cited

U.S. PATENT DOCUMENTS

| | | | |
|---|---|---|---|
| 2,988,237 | 6/1961 | DeVol, Jr. | 214/1 CM X |
| 3,543,952 | 12/1970 | Young | 214/14 |
| 3,631,993 | 1/1972 | Young | 214/14 X |
| 3,807,582 | 4/1974 | Anderson | 214/14 |
| 3,812,987 | 5/1974 | Watatani | 214/14 X |
| 3,881,608 | 5/1975 | Hupkes | 214/14 |
| 3,952,891 | 4/1976 | Terayama et al. | 214/15 R X |

FOREIGN PATENT DOCUMENTS

| | | | |
|---|---|---|---|
| 1556783 | 6/1970 | Fed. Rep. of Germany | 214/14 |
| 2017198 | 10/1971 | Fed. Rep. of Germany | 212/12 |

*Primary Examiner*—Frank E. Werner
*Attorney, Agent, or Firm*—Craig and Antonelli

[57] ABSTRACT

A container crane system comprises a storage area on a crane for storing containers temporarily, a main spreader adapted for conveyance of the containers between the storage area and a ship so constructed that the containers are guided by a cell guide and stowed into a hatch of the ship, and an auxiliary spreader adapted for conveyance of the containers between the storage area and a transport system prepared on the land to the rear of the crane. The main spreader is operated automatically according to operation schedules which are previously stored in a memory by a teaching operation and whose variable components are corrected during the automatic operation through a corrective (or modified) playback operation, while the auxiliary spreader is automatically operated through a programmed operation schedule.

8 Claims, 26 Drawing Figures

METHOD AND APPARATUS FOR AUTOMATIC OPERATION OF CONTAINER CRANE

LIST OF PRIOR ART REFERENCES (37 CFR 1.56 (a))

The following references are cited to show the state of the art:

U.S. Pat. No. 3,812,987, May 28, 1974, Minoru Watatani

The Journal of ICHCA "CARGO SYSTEMS" Vol. 3, No. 5, May 1976, pages 12, 13 and 15

BACKGROUND AND SUMMARY OF THE INVENTION

This invention relates to method and apparatus for automatic operation of a container crane of a type for loading and unloading a cargo, especially, containers carried on a ship, or more in particular to method and apparatus for automatic operation of a container crane with a container storage area thereon for automating cargo conveyance between the storage area which is used as the container handling origin and the ship, i.e., the ship-side conveyance, and cargo conveyance between the storage area and the transportation equipment prepared at the rear of the crane, i.e., the land-side conveyance.

In the operation for loading and unloading cargo containers onto and from a ship moored to the quay of a port, cargo conveyance between the container ship and the quay has been effected with a container crane provided on the quay, while the conveyance between the quay and a container yard at the rear thereof has been carried out by suitable transport equipment such as a straddle carrier, truck or yard crane.

In unloading a container from a container ship, for example, the container crane is operated in such a cycle that it first lifts the container vertically upward from the container ship, moves it horizontally in the direction at the right angle to the quay side and then brings it down on the quay. In the case where the conveyance cycle of the transport equipment at the rear of the crane fails to conform to that of the container crane, the container lifted by the container crane must be temporarily stored on the quay at an area not to interfere with the operation of the rear transport equipment. This adds to the work for conveyance of the container to the work for storage on the quay. If the container crane is operated in such a manner that the operation cycle of the container crane conforms to that of the rear transport equipment, by contrast, the operating efficiency of the container crane is reduced, resulting in the failure of the container crane to effect its full capacity to handle the cargo.

In order to overcome these disadvantages and improve the operating efficiency of the container crane, various types of container crane systems have been suggested which comprise a container crane with a storage area thereon for temporarily storing containers and an auxiliary spreader for conveyance of the containers between the storage area and the transport equipment prepared at the rear of the container crane. One of such types of container crane is disclosed in the Journal of ICHCA Cargo System, pages 13 and 18, issued May, 1976 as well as in U.S. Pat. No. 3,812,987 issued May 28, 1974 on U.S. application Ser. No. 193,276 filed Oct. 28, 1971. Such types of container crane, as described above, have a storage area thereon for storing containers. The location of this storage area is used as a cardinal point in the control of the system for carrying out the ship-side operation between the container ship and the storage area of the container crane and the land-side operation between the storage area and the transport equipment independently of each other. This not only reduces the time required for one operation cycle of the container crane but also improves the operating efficiency thereof.

This type of crane has separate control cabs for the ship-side and land-side cargo handling operations. The operators in these control cabs carry out the ship-side and land-side cargo operations separately. The ship-side cargo handling operation, for example, requires six to eight stevedores on board in addition to the operator in the control cab relates to main spreader. The operator, by manual operation, places the spreader in position in the vicinity of a target point of the cargo handled, and then the stevedores correct the spreader position. After that, the crane operator operates, with aid of the stevedore's sign, to locate the spreader exactly in position for container handling operation. The land-side operation is also accompanied by several helpers working in the transport equipment prepared at the rear of the crane, so that with the aid of helpers signals the crane operator of auxiliary spreader operates the crane to perform the cargo-handling operation.

The cargo-handling operation by the container crane in the above-mentioned system requires high skill of the crane operators. Further, the requirement of additional helpers (or stevedores) poses a safety problem. The most serious problem, however, is that the requirement of the work by helpers (or stevedores) increases the cargo-handling time and hence additional demurrage, thereby reducing the efficiency of cargo-handling operation.

An object of the present invention is to provide a method and an apparatus for automatic operation of a container crane, which is capable of automatically performing the ship-side and land-side cargo-handling operations of the container crane.

Another object of the invention is to provide a method and an apparatus for efficient and safe automatic operation of a container crane at low cost of the ship-side and land-side operation of the container crane.

The objects of the present invention are achieved by a container crane system comprising a crane with a container storage area thereon, a main spreader for performing the ship-side cargo-handling operation between the storage area and a container ship having a hatch into which the container is transported along a cell guide, and an auxiliary spreader capable of performing the land-side cargo-handling operation between the storage area and the transport equipment prepared at the rear of the crane by controlling the same in such a manner that in ship-side operation, the main spreader is first subjected to teaching operation with respect to desired points on and within the hatch to determine the positions of the ship and the crane relative to the ship-side end of the storage, then storing in memory the ship and the crane relative positions. In subsequent cargo-handling processes, the information thus stored, together with the geometric relation of container-loading positions determined by the ship structure, displacement of relative positions of the ship and the container crane, the state conditions of the main spreader and the crane, and the like, are used to calculate a target operation point for the main spreader.

Then, the main spreader is operated through corrective playback control by which the spreader position is automatically corrected in accordance with the information thus obtained, while in the land-side cargo-handling operation, on the other hand, the travel schedules between the land-side end of the storage area and the transport equipment located at the rear of the crane are programmed, so that an auxiliary spreader is automatically operated in accordance with the program.

BRIEF DESCRIPTION OF THE DRAWINGS

The present invention will be apparent from the following detailed description taken in conjunction with the accompanying drawings, in which:

FIGS. 17*a* to 17*d* are diagrams showing various conditions of the container when inserted into the cell guide, in which FIGS. 17*a* shows a condition where the lower side of the container comes in contact with an inlet member of the cell guide, FIG. 17*b* a condition where the lower side of the container is released from contact with the cell guide, FIG. 17*e* a condition where the container is about to be inserted into the cell guide and FIG. 17*d* a condition where the container is at a finishing position in insertion into the cell guide;

FIGS. 19*a* to 19*d* are diagrams for explaining the container handling operation on the hatch in which FIG. 19*a* is a general view of the spreader carrying a container moved from the cargo-handling origin to the target cargo-handling point, FIG. 19*b* a diagram showing the container carried by the spreader to be positioned into the target cargo-handling position, FIG. 19*c* a diagram showing the spreader and container being moved downward after positioning, and FIG. 19*d* a diagram showing the container being unloaded at the target cargo-handling position;

DETAILED DESCRIPTION OF THE DRAWINGS

Embodiments of the present invention will be described in further detail below with reference to the accompanying drawings.

Figure 1:
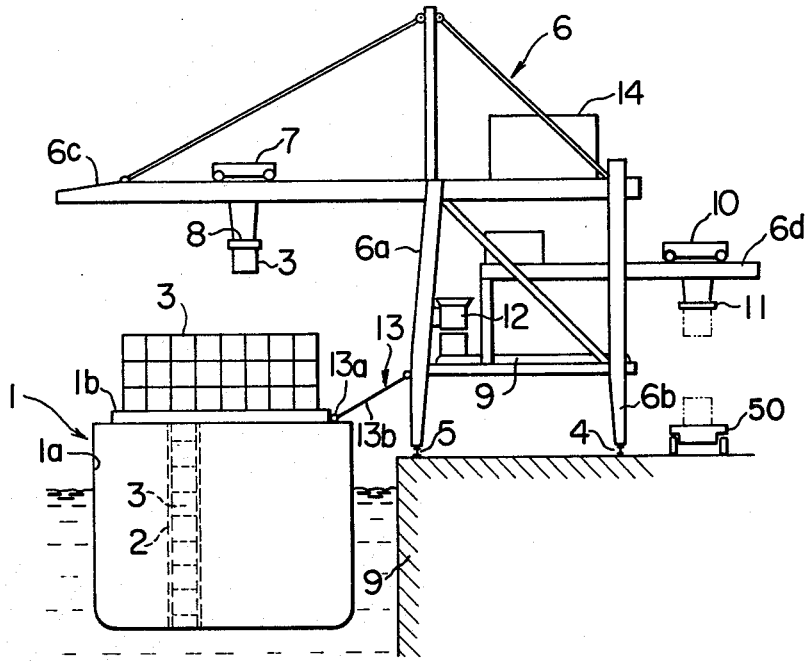
FIG. 1 is a front view of the whole construction of a container crane.
Figure 2:
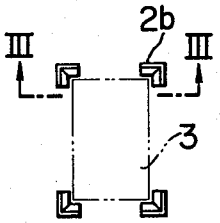
FIG. 2 is a plan view of the cell guide provided in the container ship.
Figure 3:
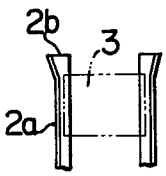
FIG. 3 is a sectional view taken along the line III—III in FIG. 2.

The container loading and unloading operations by use of a container crane having the devices according to the present invention are shown in FIG. 1. In this drawing, a container ship 1 has a cell guide 2 in the hatch 1*a*. Containers 3 are loaded in the hatch 1*a* to the full capacity thereof, and in addition are stacked in about three layers on the hatch cover 1*b* covering the opening of the hatch 1*a*. The cell guide 2 is arranged along the longitudinal direction in the container ship, and as shown in FIGS. 2 and 3, includes vertical members 2*a* for guiding the four corners of the container 3 and inlet members 2*b* provided at the upper part thereof.

A container crane 6 adapted to move along the rails 5 is located on the quay 4. The container crane 6 roughly comprises a ship-side leg 6*a*, a land-side leg 6*b*, a main girder 6*c* and an auxiliary girder 6*d*. An end of the main girder 6*c* is extended to the sea and includes a main trolley 7 for lateral movement thereon. A main spreader 8 for handling the container 3 is suspended from the main trolley 6. Further, the main trolley 7 is provided with a device for laterally inching the main spreader 8 at an accuracy in the order of 10 mm.

The auxiliary girder 6*d* is mounted on the land-side leg 6*b* at such a minimum height as to grasp and unload the container 3 from the container conveyer 9 described later. The auxiliary girder 6*d* is provided with an auxiliary trolley 10 adapted to laterally move thereon. From the auxiliary trolley 10 an auxiliary spreader 11 is suspended. On the ship side portion of the conveyor 9, there is provided a container hopper 12 which determines the boundary between the ship-side cargo-handling operation by the main spreader and the land-side cargo-handling operation by the auxiliary spreader 11. This container hopper 12 is used to guide and place in position the main spreader 8. The conveyor 9 is located at a relay point between the ship-side and land-side cargo-handling operations for transferring to a predetermined point under the auxiliary 6*d* the container 3 brought down on the conveyor 9 through the container hopper 12. Also, the conveyor 9 acts as a storage area of the containers 3.

The location of the container hopper 12 determines a crane operation-dividing point, that is, a cardinal point or origin where ship-side and land-side cargo-handling operations are divided. In the shown embodiment, the land-side cargo-handling operation is performed by a system comprising the container hopper 12, the conveyor 9, the auxiliary girder 6*d* and the auxiliary spreader 11. As an alternative, however, it is possible to employ an elevator-like system which permits automatic conveyance of the containers 3 to a transfer car or truck or other transport equipment 4*a* positioned beside the land-side leg of the container crane 6. The ship-side cargo-handling operation is performed exclusively between the ship 2 and the container hopper 12 by means of the main spreader 8 supported on the main girder 6*c*. Thus, the position of the container hopper 12 is fixed and adapted to be used as an orgin for positioning the main spreader 8.

The ship-side leg 6a is provided with a device 13 for detecting the variations in the relative positions of the container ship 1 and the crane 6. The detector device 13 which includes an arm 13b and a probe 13a to be in slidable contact with the hatch opening of the container ship 1 thereby to detect the relative position of the container ship 1 to the crane 6 and its variation on the basis of the length and the tilting angle of the arm 13b by means of, for example, a potentiometer (not shown) whose sliding contact is connected to the arm 13b.

Figure 4:
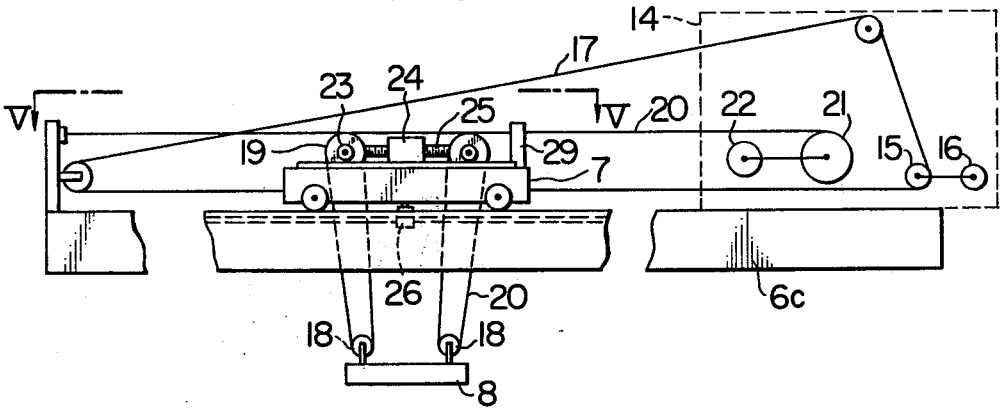
FIG. 4 is a front view of a driving equipment for a trolley and the spreaders.
Figure 5:
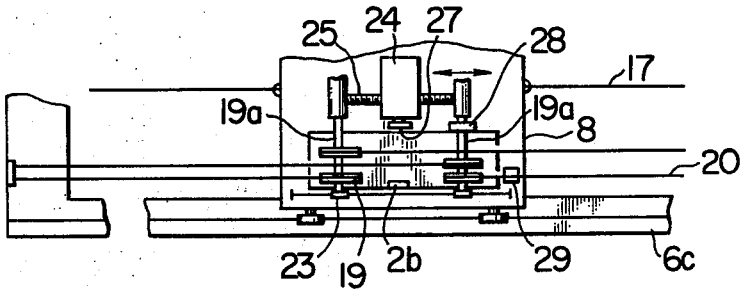
FIG. 5 is a sectional view taken along the line V—V in FIG. 4.

The configuration of the main trolley 7, the driving equipment for the main spreader 8 and the lateral inching device for the main spreader 8 will be described with reference to FIGS. 4 and 5. In the drawings, the main trolley 7 is driven laterally through a lateral drum 15 mounted in a machine room 14 on the main girder 6c, a lateral motor 16 for driving the lateral drum 15, and a lateral rope 17. The main spreader 8 is moved up and down by the construction comprising spreader sheaves 18 on the main spreader 8, sheaves 19 on the main trolley 7, hoisting ropes 20 hung on the sheaves 18 and 19, a hoisting drum 21, and a hoisting motor 22. A pair of shafts 19a of the sheaves 19 are adapted to move along the main trolley 7 by means of the rollers 23 and connected to each other through a sheave-driving motor 24 and a feed screw mechanism 25. By driving the sheave-driving motor 24, the shafts 19a of the sheaves 19 move to laterally inch the main spreader 8. The main trolley 7 is provided with a lateral position detector 26 which may be of a well-known type including, for example, a linear synchro, a lateral inching position detector 27 which may be of a well-known type including, for example, a potentiometer, for detecting the lateral inching position of the main spreader 8 on the basis of the revolutions of the sheave-driving motor 24, a vertical position detector 28 which may be a counter for detecting the revolutions of the hoisting drum and a load detector 29 which may be a strain gauge type load cell for detecting the downward load of the main spreader 8. The values produced from the detectors 26 to 29 are used as representing the state conditions of the main spreader 8 and the crane 6 as mentioned later.

Figure 6:
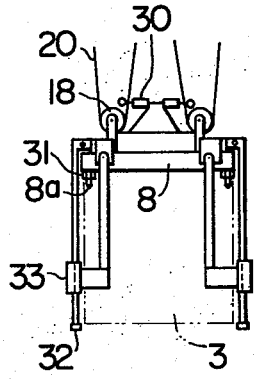
FIG. 6 is a front view of the spreader section.
Figure 7:
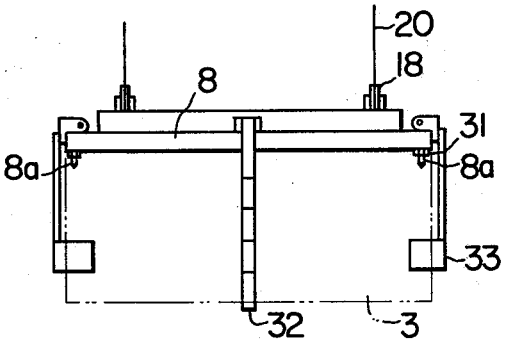
FIG. 7 is a side view of the spreader section shown in FIG. 6.
Figure 8:
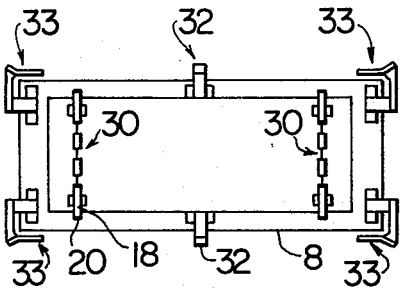
FIG. 8 is a plan view thereof.

The main spreader 8 includes twist lock pins 8a at the lower four corners thereof, which pins are fitted into the pin holes of the container 3 as shown in FIGS. 6 to 8. The twist lock pins 8a are arranged to slide upward in relation to the main spreader 8 when the lower side of the container 3 is brought into contact with the inlet members 2b of the cell guide 2 during the downward movement of the main spreader 8 with the container 3 being suspended by the main spreader 8. The main spreader 8 includes various detectors and a posture control device 30 for the container 3 in order to facilitate the handling of the container 3 on the hatch and the insertion of the container 3 into the cell guide 2 in the hatch on the one hand and to assure safety in full-speed handling of the container 3 within the cell guide 2 on the other hand. The detectors used for this purpose include a device 31 for detecting the insertion of the container into the cell guide 2, a device 32 for detecting the condition of the lower part of the spreader 8, a device 33 for detecting the condition of an adjacent container, in addition to a detector for detecting the floor landing of the spreader 8 and an interlock detector. For the purpose of this specification, however, the posture control device 30 and the detectors 31 to 33 will be described below.

Figure 9:
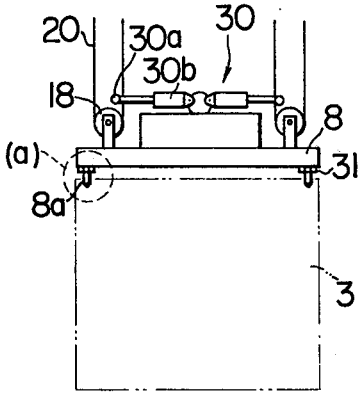
FIG. 9 is a front view showing a device for detecting the insertion into the cell guide and a container posture control device.
Figure 10:
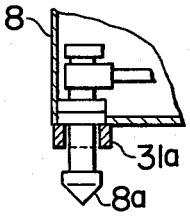
FIG. 10 is an enlarged view of part (a) in FIG. 9.

The configurations of the device 31 for detecting the insertion of the container 3 into the cell guide 2 and the posture control device 30 for the container 3 are shown in FIGS. 9 and 10. The device 31 for detecting the insertion of the container 3 into the cell guide 2 is comprised of four detectors 31a provided on the twist lock pins 8a on the lower side of the main spreader 8. The detector 31a may be a limit switch which actuates upon contact with the cell guide. The device 31 thus detects which one of the four corners of the spreader is a point where the container 3 or the main spreader 8 is in contact with the cell guide 2. The posture control device 30 for the container 3 is located on the upper side of the main spreader 8, and is comprised of four units each including an adjusting sheave 30a whose one end is slidably engaged with the hoisting rope 20, and a cylinder 30b for moving the adjusting sheave 30a. The posture control device 30, in response to a command from one of the detectors 31a, actuates the cylinder 30b and the adjusting sheave 30a of the unit which is located at the diagonally opposite corner to the corner where the actuated detector 31a is located, so as to adjust the path length of the hoisting rope 20, with the result that the container 3 is tilted to facilitate the insertion of the container 3 into the cell guide 2.

Figure 11:
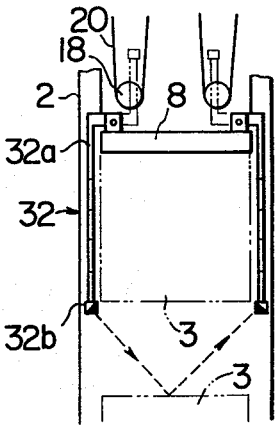
FIG. 11 is a front view showing a device for detecting the condition of the lower part of the container.

The spreader lower-part condition detector device 32 includes two units as shown in FIG. 11. This device 32 is used when the main spreader 8 moves down in the cell guide 2 for assuring the safety of the main spreader 8 running downward even at full speed. The detector unit 32 is located in the space on each of both sides of the main spreader 8 between it and the cell guide 2, and in operation, extends its expansion arm 32a under neath along the side of the main spreader 8 thereby to detect a blockage of the path, if any, by means of a well-known reflective sensor 32b or, for example, the photo reflective type the ultra sonic reflective type, provided at the lower end thereof. In response to a detection signal, the movement of the spreader is controlled. The detector unit 32 is arranged such that, when it is not used, the expansion arm 32a is contracted as shown by the two-dot chain in FIG. 11 and turned to the upper side of the spreader , thereby preventing interference with the container handling operation on the hatch.

Figure 14:
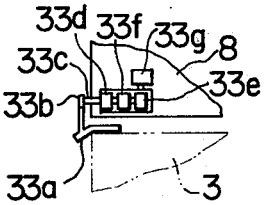
FIG. 14 is a sectional view along the line XIV—XIV in FIG. 13.
Figure 12:
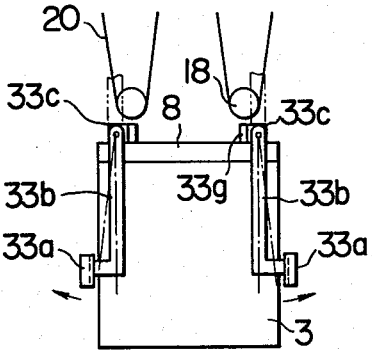
FIG. 12 is a front view of a device for detecting the condition of an adjacent container.
Figure 13:
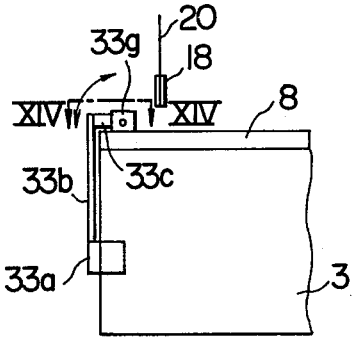
FIG. 13 is a side view of the device shown in FIG. 12.
Figure 20:
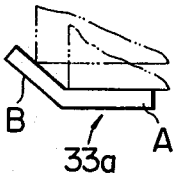
FIG. 20 is an enlarged view of a part of the device of FIG. 13.

The detail of the adjacent container condition detecting equipment 33 will be described with reference to FIGS. 12 to 14. The detecting equipment 33 is used for the purpose of positioning the main spreader 8 safely and quickly on the containers 3 in handling them stacked closely on the hatch. Similar detecting equipment 33 are provided at four corners of the upper side of the main spreader 8, and each of them comprises a rotational shaft 33c the arms 33b and 33b with a contact plate 33a, a spring 33d and a motor 33e for tilting the arm 33b outwardly of the main spreader 8 as shown by a dotted line in FIG. 12, an angle detector 33f for detecting the contact with an adjacent container 3, and a swinging motor 33g for turning the detecting equipment clockwise in view of FIG. 13 until it extends on the upper side of the main spreader 8 longitudinally of the main spreader 8 to protect the equipment from clash against surroundings. In detecting an adjacent container 3, the arm 33b is turned counterclockwise to extend along the side of the main spreader 8 by means of the swinging motor 33g. Under this condition, the arm 33b is tilted outwardly as shown by a two-dot chain in FIG. 12. As the arm 33b moves towards the main spreader 8 by a predetermined length as a result of being brought into contact with an adjacent container due to the lateral inching of the main spreader 8, the condition of the adjacent container i.e., the separation between the container handled by the main spreader 8 and the adjacent container is detected by the angle detector 33*f*. The main problem in handling of the container 3 is the direction of main trolley 7, i.e., the positioning thereof in lateral direction. Preferably, in order to eliminate the small deflection of the travelling direction of the crane 6, the contact plate 33*a* should be constructed in hook form to include, as shown in FIG. 20, a parallel portion A extending parallely to the longitudinal side of the container 3 and an inclined portion B so that the corner of the container slides on the inclined portion B for facilitating the positioning of the container 3 by moving it from a position shown by a two-dot chain line to a position shown by a solid line.

The foregoing description concerns the construction necessary for ship-side cargo-handling operation. Next, the construction required for land-side cargo-handling operation will be explained.

The driving apparatus for the auxiliary trolley 10 and the auxiliary spreader 11 will not be explained here in detail as it is identical with that for the main trolley 7 and the main spreader 8 except that the former has no driving gear for lateral inching. The auxiliary girder 6*d* has driving means for driving the auxiliary trolley 10 laterally along the auxiliary girder 6*d* and driving means for driving the auxiliary spreader 11 vertically in relation to the auxiliary trolley. Also, the auxiliary trolley 10 is provided with a vertical position detector for detecting the vertical movement of the auxiliary spreader 11. Further, a lateral position detector for detection of the lateral position of the auxiliary trolley 10 is located between the auxiliary trolley 10 and the auxiliary girder 6*d*. The vertical position detector and the lateral position detector are similar to those provided on the main spreader.

Figure 15:
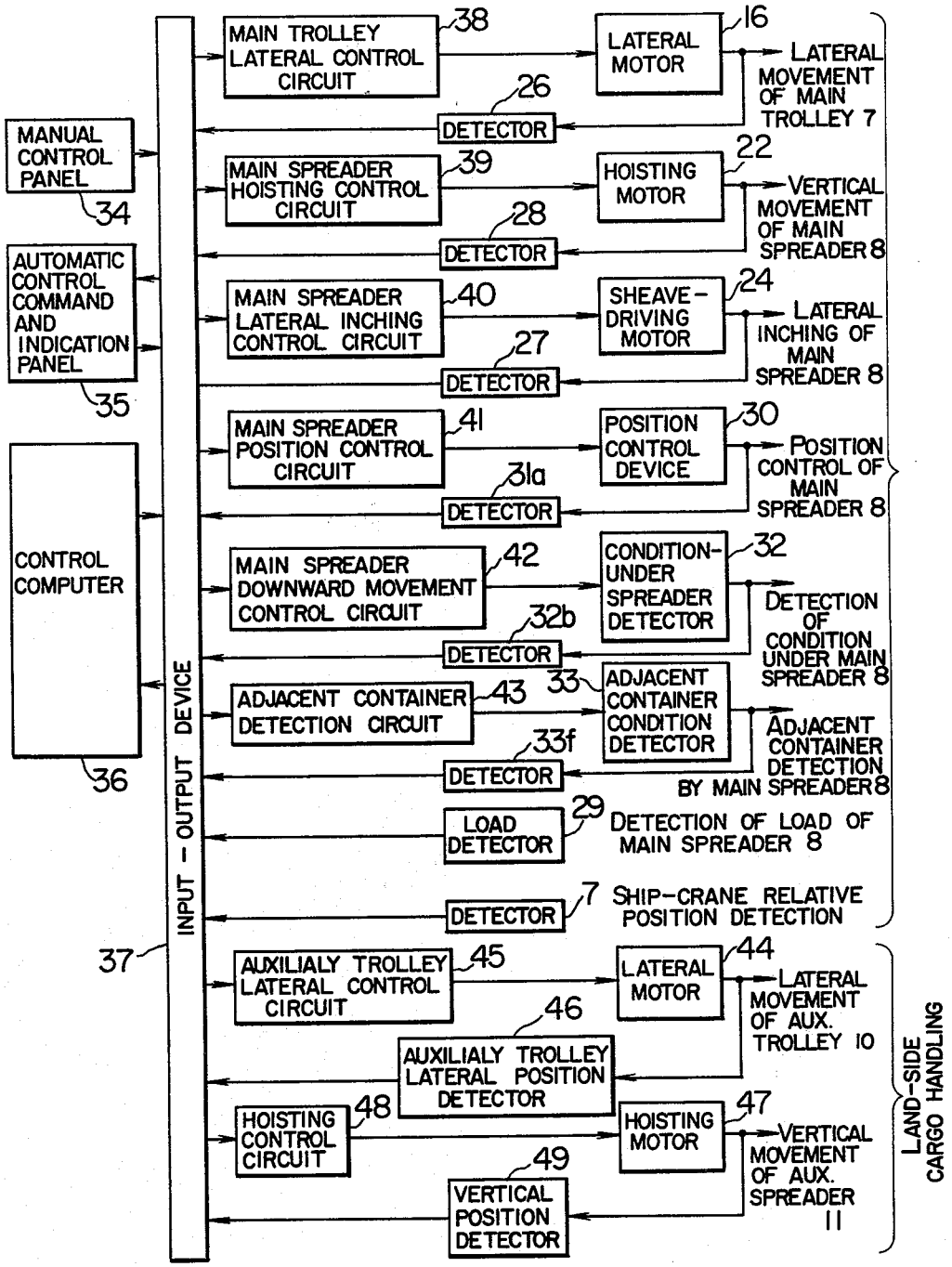
FIG. 15 is a block diagram showing a configuration of the control circuit.

A circuit configuration for controlling the above-mentioned detectors and driving apparatus is shown in FIG. 15. In this drawing, like reference numerals denote like component elements in the aforementioned drawings. In FIG. 15, reference numeral 34 shows a manual control panel, numeral 35 an automatic control command and indication panel, numeral 36 a control computer, numeral 37 an input-output device, numeral 38 a main trolley lateral control circuit, numeral 39 a main spreader-hoisting control circuit, numeral 40 a main spreader lateral inching control circuit, numeral 41 a main spreader position control circuit, numeral 42 a main spreader downward movement control circuit, numeral 43 an adjacent container detection control circuit, numeral 44 a lateral motor for laterally driving the auxiliary trolley 10, numeral 45 an auxiliary trolley lateral control circuit, numeral 46 an auxiliary trolley lateral position detector, numeral 47 a hoisting motor for driving vertically the auxiliary spreader 11, numeral 48 a hoisting control circuit, and numeral 49 a vertical position detector.

In this control circuit configuration, the analog control of the driving gears such as the lateral motor drive, the hoist motor drive and so on is effected by exclusive driving control devices, while the control of the sequence of the whole cargo-handling operations, logic decision thereof, confirmation of safety and the like is effected by the control computer 36. The operation of each driving gear is controlled in a well-known manner by using a feed-back system through a detector associated therewith and hence more detailed explanation will be unnecessary.

In general container-handling operation, the work in the hatch is preceded by that on the hatch since the containers 3 are fully loaded both in the hatch 1*a* and on the hatch cover 1*b* of the container ship 1. For convenience of explanation, however, the cargo-handling operation in the hatch will be first explained. Assume the case of ship-side cargo-handling operation wherein the containers 3 are unloaded from the container ship 1. The same principle applies to the loading operation.

The ship-side cargo-handling operation comprises the teaching control by manual operation, the corrective playback control by automatic operation, and the learning control for correcting the positioning error of the spreader.

Figure 16:
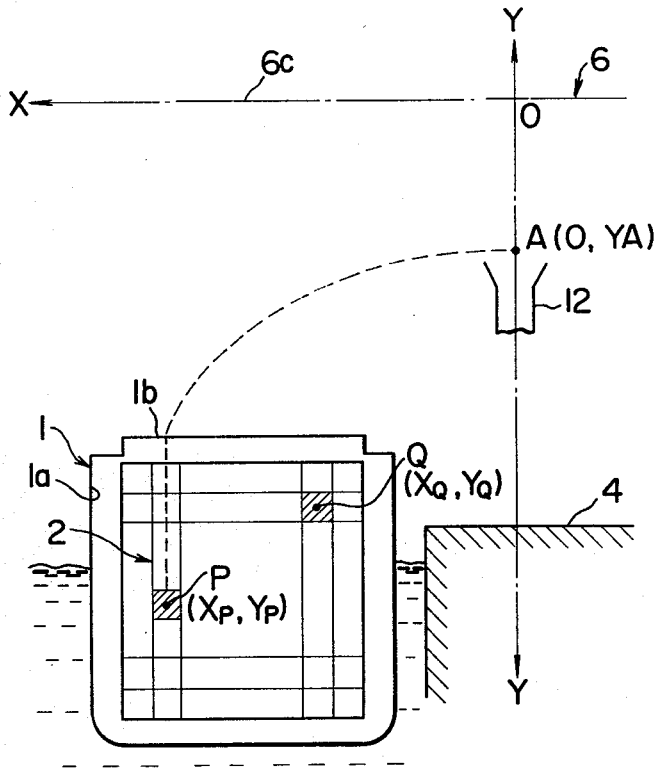
FIG. 16 is a diagram for explaining the container handling operation for stowing the container into the ship hatch.

First, as shown in FIG. 16, imaginary rectangular coordinates are set on the crane 6 and a cargo-handling origin A on the container hopper 12. In this coordinate system, the main spreader 8 is moved from point A to the inlet of the cell guide 2 of the hatch 1*a* in a time as short as possible by manual operation, and then the main spreader 8 is hoisted in position at a speed as high as possible along the cell guide 2 thereby to handle the container 3 located at point P. The coordinate ($X_P$, $Y_P$) of the container 3 at point P under this condition in stored in the control computer 36 on the basis of the values detected by the lateral position detector 26, the vertical position detector 28 and the load detector 29. Thus the teaching control is completed.

This is followed by the corrective playback control, which will be explained with reference to the teaching control operation. Assume that the container 3 positioned at point Q is to be handled. The container position ($X_Q$, $Y_Q$) at point Q is calculated with reference to the container position at point P according to the container loading data based on ship construction, although the container ship 1 changes in position due to the reduction in load or effect of the tide. This change is detected by the detector 7 and applied to the control computer 36. For this purpose, the control computer 36 correctly calculates the container position at point Q. According to thus calculated information, the main spreader 8 handles the container 3 at point Q and unloads it up to the handling origin A. By repetition of this corrective playback control operation, automatic handling operations of the containers 3 within the hatch is performed.

Figure 17A:
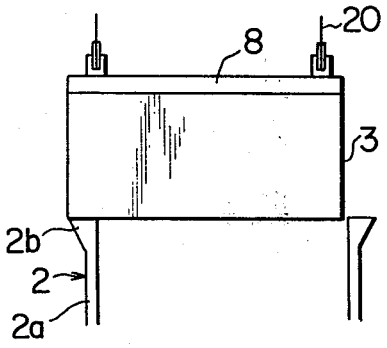
Figure 17B:
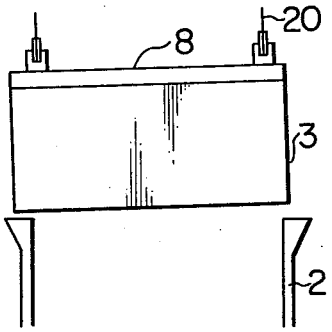
Figure 17C:
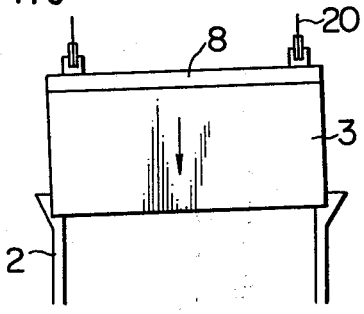
Figure 17D:
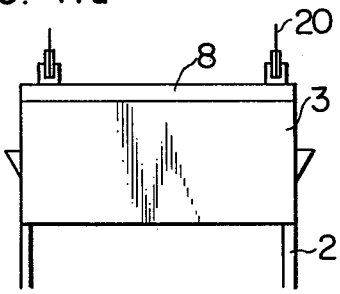

Assume again that during the insertion of the container 3 into the cell guide 2 for automatic cargo-handling operation, the lower side of the container 3 comes in contact with an inlet member 2*b* of the cell guide 2 as shown in FIG. 17*a*. The container 3 or the twist lock pins 8*a* move upward in relation to the main spreader 8, so that one of the detectors 31*a* is actuated to produce a signal as mentioned hereinbefore. As a result, the posture control device 30 operates in response to a signal from any one of the detectors 31*a* to actuate the cylinder 30*b* which is located in diagonal opposition to the detector 31*a* deriving the signal so as to raise one side of the container 3 as shown in FIG. 17*b* thereby separating the bottom side of the container from the cell guide 2. After that, by moving the main spreader 8 downward, the container 3 is inserted into the cell guide 2 as shown in FIGS. 17*c* and 17*d*. The main spreader 8 having no container 3 suspended therefrom may also be smoothly inserted into the cell guide 2 by the same processes.

Figure 18:
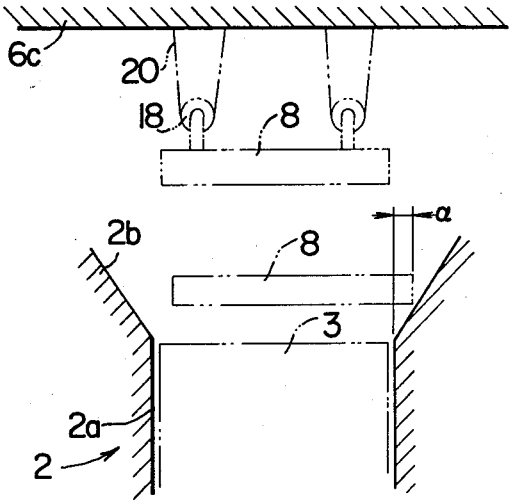
FIG. 18 is a diagram for explaining the learning control operation.

In the above-mentioned automatic cargo-handling processes, a positioning error for the main spreader 8 may occur due to such factors as the deflection in certain direction of the main spreader 8 caused by wind. Such an error is corrected by the learning control. Assume now that, as shown in FIG. 18, the main spreader 8 is deflected by a distance $\alpha$ from the cell guide 2 and brought into contact with an inlet member 2*b* of the same. The learning control detects through the detector 31*a* the existence of deflection $\alpha$, so that the cargo-handling operation for that cycle is carried out merely for poise-correction of the main spreader 8 without moving the same upward. However, if the main spreader 8 rests on the upper end of the cell guide 2, the main spreader 8 is once moved upward and then inserted into the cell guide 2. In the next several cargo-handling cycles the cargo-handling operation is repeated with correction of such deflection $\alpha$ until the insertion of the container 3 into the cell guide 2 is carried out smoothly without any posture correction. This shortens the cargo-handling time.

The container-handling operation on the hatch will be described next. Here, reference is made to the case where the container 3 is to be loaded in the container ship 1. The same principle applies to the unloading operation.

As in the handling of the container 3 within the hatch, the teaching control first stores the path of the main spreader 8 for movement from the cargo-handling origin A to the container 3 on the hatch. In subsequent handling of other containers, the control computer 36 calculates, by adding for correction, the change in the position of the container ship 1 relative to the position of the crane 6 to the information of the reference position of the container 3 which has been obtained by the teaching control operation, the position of another container 3 to be handled next. Thus, in response to the corrective playback control command obtained from the control computer 36, the container 3 is automatically handled.

Figure 19A:
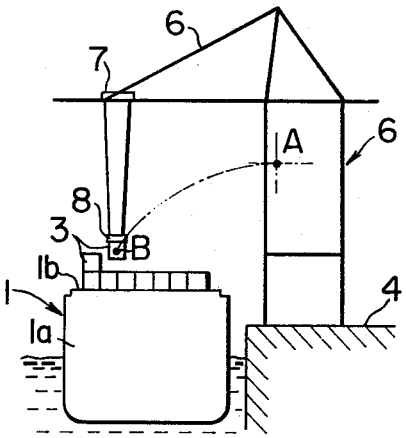
Figure 19B:
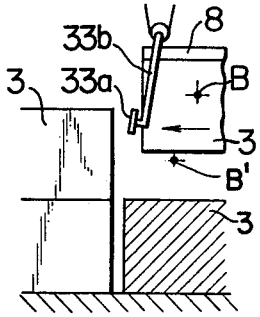
Figure 19C:
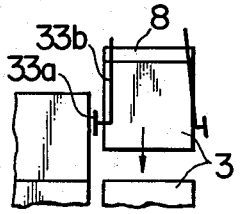
Figure 19D:
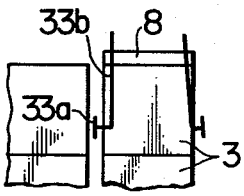

It will be seen from the foregoing description that the automatic handling of the containers on the hatch is performed satisfactorily by the teaching control and the corrective playback control operation. By the use of the adjacent container condition detector 27, however, the learning control operation may be effected to improve the positioning accuracy of the spreader 8. In other words, as shown in FIGS. 19*a* and 19*b*, *the spreader 8 suspending the container 3 is moved first to the point B in the vicinity of the target cargo-handling point B' from the cargo-handling origin A, while as shown in FIG. 19b,* the arm of the adjacent container condition detector 33 is turned into the operating position. The point B in the vicinity of the target cargo-handling point B' of the main spreader 8 is detected by the lateral position detector 26 and the vertical position detector 28 and stored in the control computer 36. Next, as shown in FIG. 19*b*, the main spreader 8 is inched laterally in the direction of the arrow so that the contact plate 33*a* is brought into contact with an adjacent container and inserted in a predetermined direction inwardly. The angle detector 33*f* is actuated, thereby stopping the lateral inching of the main spreader 8. The main spreader 8 moves down to unload the container 3 onto another container 3 shadowed in the drawing. In the process, the position of the main spreader 8 is controlled while being compared with the target cargo-handling point B' calculated beforehand. The deflection of the position of the main spreader 8 from the target cargo-handling point B' is used for correction in the next cargo-handling cycle. In this manner, the learning control of the handling of the containers on the hatch is realized.

The land-side cargo-handling operation will be described below.

The container 3 inserted into the container hopper 12 by the main spreader 8 is placed on the conveyor 9 and transferred to under the auxiliary girder 6*d* as shown in FIG. 1. By the auxiliary spreader 11 mounted on the auxiliary girder 6*d*, the container 3 is placed on the transfer car 50 positioned beside the land-side leg 6*d* of the crane 6. In this process, the land cargo-handling operation carried out after insertion of the container 3 into the container hopper 12 can be carried out by automatic operation of the auxiliary girder system 6*d* according to a programmed sequence control without the necessity of correction of the control because the transportation path during the process is substantially constant.

In loading the container 3 on the ship, the processes reverse to those mentioned above apply. In other words, by the auxiliary spreader 11 and the conveyor 9, the container 3 is placed under the container hopper 12 and then it is loaded in the ship 1 by means of the main spreader 8.

It will be understood from the foregoing explanation that according to the present invention, both the ship-side and land-side cargo-handling operations by the container crane 6 are automated. Especially in the case of ship-side cargo-handling operation, the teaching control is effected in the beginning of cargo-handling. After that, the coverage of the main spreader 8 which is determined by the teaching control operation is corrected by such factors as the variation in the relative position of the container ship with respect to the crane. In accordance with this corrected coverage, the main spreader is operated to automate the handling of the containers in and on the container ship 1 by the corrective playback control operation. As compared with the conventional systems, the system according to the present invention thus greatly improves the cargo-handling efficiency on the one hand and considerably saves the cargo-handling labor on the other hand.

What we claim is:

1. A method for automatic operation of a container crane of the type which comprises a container storage area, a main spreader for effecting ship-side cargo-handling operation for conveyance between said storage area and a container ship which is equipped with a cell guide for guiding a container into a hatch of said container ship and an auxiliary spreader for effecting land-side cargo-handling operation for conveyance between said storage area and transport equipment prepared at the rear of said crane, said method comprising the steps, for effecting said ship-side cargo-handling operation, of effecting a teaching operation in which said main spreader is brought to a given point on or in the hatch of said container ship to detect and store information of the position of the ship relative to the position of a ship-side end of said storage and effecting a corrective playback operation in which the position of said main spreader is automatically controlled according to a position of a container to be handled, said container position being calculated on the basis of said stored information and additional information on the geometric position of said container which is determined by the construction of said container ship, variation in position of said ship relative to said crane and state conditions of said main spreader and said crane, said method further comprising the steps, for effecting said land-side cargo-handling operation, of programming the schedule for conveyance between said storage area and said transport equipment and controlling the operation of said auxiliary spreader according to said programmed schedule.

2. A method according to claim 1, further comprising the step of effecting a learning operation in which said calculated container position is corrected by variation in position of said container relative to said crane during said ship-side cargo-handling operation.

3. An automatic control apparatus for a container crane of the type which is equipped with a container storage area, and capable of effecting an independently ship-side cargo-handling operation for conveyance between said storage area and a hatch of said ship into which a container is guided through a cell guide and land-side cargo-handling operation for conveyance between said storage area and transport equipment prepared at the rear of said crane, said apparatus comprising a main trolley adapted to laterally travel on a main girder extended toward the sea from said crane, a main spreader mounted vertically movably on said main trolley and having the function to hold said container, an auxiliary trolley adapted to laterally travel on an auxiliary girder extended toward the land from said crane, an auxiliary spreader mounted vertically movably on said auxiliary trolley and having the function to hold said container, driving means for laterally inching said main spreader in relation to said main trolley, means for controlling the position of said main spreader, means for detecting the separation between said main spreader in selected ones of the container-holding and container-released conditions and said container on said hatch cover, means for detecting any abnormality of insertion of said main spreader in one of said conditions into said cell guide in said hatch, means for detecting the condition under said main spreader in said cell guide of said hatch, means for detecting the relative positions of said ship and said crane and variations in said relative positions, and a control section including main spreader automatic operation control means for controlling the position and operation of said main spreader in response to the signal from said variations detector means and auxiliary spreader automatic operation control means.

4. An apparatus according to claim 3, in which said means for laterally inching said main spreader includes at least a sheave for a rope for vertically driving said main spreader laterally inching on said main trolley, and a driving mechanism for inching said sheave.

5. An apparatus according to claim 3, in which said means for detecting any abnormality of insertion of said main spreader into said cell guide in said hatch and said means for controlling the posture of said main spreader includes a detector for detecting a tilted condition of said main spreader in selected one of a container-holding and container-released conditions, said tilting occurring when said main spreader is inserted onto a rack of said hatch, and a mechanism mounted on said main spreader and actuated by said detector for changing the length of said vertically-driving rope for said main spreader.

6. An apparatus according to claim 3, in which said means for detecting the separation between said main spreader and said container on said hatch cover includes a plurality of probe arms swingingly provided at the four corners of said main spreader, said probe arms being located on the sides of said main spreader when in operation and contained on said main spreader when out of operation, a plurality of contact plates provided on the lower end of said probe arms, and a plurality of detectors for detecting the degree of the swinging of said probe arms attributable to the contact thereof with said container.

7. An apparatus according to claim 3, in which said means for detecting the condition under said main spreader in said cell guide of said hatch is disposed on the sides of said main spreader between said main spreader and said cell guide when in operation, said means being swingingly disposed on the side of said main spreader in such a manner as to be contained on said main spreader when out of operation, said detector means including at least a pair of expansion arms, and sensors mounted on the lower end of said probe arms for detecting any stumbling block under said main spreader.

8. An apparatus according to claim 3, in which said automatic operation control means for said control section includes a control computer for storing the sequence of the ship-side cargo-handling operations performed manually, said control computer producing a command for control of automatic cargo-handling operation of said main spreader and said auxiliary spreader on the basis of the information stored in said control computer.

* * * * *